US006284447B1

(12) United States Patent
Ly et al.

(10) Patent No.: US 6,284,447 B1
(45) Date of Patent: Sep. 4, 2001

(54) COLOR PHOTOGRAPHIC SILVER HALIDE MATERIAL

(75) Inventors: Cuong Ly, Cologne; Dieter Rocksser, Leichlingen; Edgar Draber, Odenthal; Markus Geiger, Langenfeld; Jürgen Heinecke; Randolph Trommer, both of Leichlingen, all of (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/545,378

(22) Filed: Apr. 7, 2000

(30) Foreign Application Priority Data

Apr. 14, 1999 (DE) ..... 199 16 650

(51) Int. Cl.[7] ..... G03C 1/08; G03C 7/26; G03C 7/32

(52) U.S. Cl. ..... 430/551; 430/502; 430/543; 430/607

(58) Field of Search ..... 430/502, 543, 430/544, 607, 551

(56) References Cited

U.S. PATENT DOCUMENTS 4,366,240 * 12/1982 Lassig et al. ..... 430/542
5,190,852 * 3/1993 Matsuda et al. ..... 430/517
5,981,160 * 11/1999 Odenwalder et al. ..... 430/551

FOREIGN PATENT DOCUMENTS

3006268 * 8/1981 (DE) .
3008588 * 9/1981 (DE) .
871066 10/1998 (EP) .
00/23849 * 4/2000 (WO) .

* cited by examiner

*Primary Examiner*—Janet Baxter
*Assistant Examiner*—Amanda C. Walke
(74) *Attorney, Agent, or Firm*—Connolly Bove Lodge & Hutz LLP

(57) ABSTRACT

A color photographic silver halide material which is developed as a negative, at least 90 mol % of the silver halides of which consist of AgCl, and which contains a compound of formula (I) or formula (II)

(I)

(II)

in a light-insensitive layer which is further from the support than is each light—light sensitive layer, is distinguished by its improved color reproduction.

7 Claims, No Drawings

COLOR PHOTOGRAPHIC SILVER HALIDE MATERIAL

This invention relates to a colour photographic silver halide material which is developed as a negative, at least 90 mol % of the silver halides of which consist of AgCl, and which is distinguished by good colour reproduction of magenta and red.

In order to attain the optimum properties of colour photographic materials for opaque images, processes which are matched to each other are frequently offered for sale; a defined material, a defined exposure device and defined processing baths, including a defined processing procedure, are recommended for use in processes such as these.

For reasons of cost, however, it is desirable that corresponding colour photographic materials are available which can be used irrespective of the processing method and which give the optimum results, particularly with regard to colour reproduction.

One commonly used method of attaining better colour reproduction is the use of colour couplers which exhibit narrower absorption spectra, e.g. pyrazolotriazole magenta couplers in the green-sensitive silver halide emulsion layer. However, it is known that the colours of the image which are produced by chromogenic development from this class of magenta couplers are subject to certain changes to a varying extent under the influence of environmental conditions. The effects of light, temperature and humidity are particularly pronounced here.

In order to avoid these shortcomings, EP 871 066 discloses the use of compounds of general formula (I) in a layer adjacent to the green-sensitive layer:

(I)

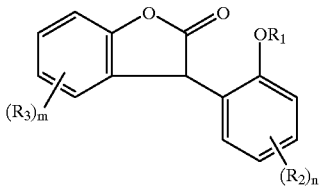

wherein $R_1$ denotes hydrogen, alkyl or acyl, $R_2$, $R_3$, independently of each other, denote alkyl, cycloalkyl, alkenyl, aryl, halogen, $OR_4$, $SR_5$, $NR_6R_7$, nitro, cyano, $SO_2R_8$, $COOR_9$, $COR_{10}$ or hetaryl, $R_4$, $R_5$, $R_9$, independently of each other, denote alkyl, cycloalkyl, alkenyl, aryl or hetaryl, $R_6$, $R_7$, independently of each other, denote H, $R_4$, $COR_{10}$, $COOR_9$, $SO_2R_8$, $R_8$, $R_{10}$, independently of each other, denote alkyl, cycloalkyl, alkenyl, aryl, hetaryl or $NR_6R_7$, n, m denote 0, 1, 2, 3 or 4, or 2 $R_2$ or $R_3$ radicals can each denote a condensed-on carbo- or heterocyclic ring, or the compound of formula I is bonded to a polymer chain via one of the $R_1$, $R_2$ or $R_3$ radicals, wherein at least one of the $R_2$ and $R_3$ radicals is situated in the para position in relation to the phenolic oxygen.

The $R_1$ acyl radicals can be radicals of an aromatic or aliphatic carboxylic, carbamic, carbonic, sulphonic, sulphinic or phosphoric acid.

Incorporation in a polymer chain can be effected via an unsaturated group, for example a styrene, acrylic acid or methacrylic acid group. One suitable monomer, for example, is

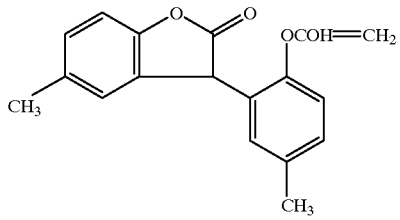

Moreover, the compound of formula I or formula II can be bonded to a polymer via a reaction analogous to polymerisation, e.g. the following compound

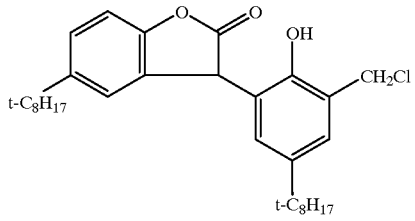

can be bonded to a polymer:

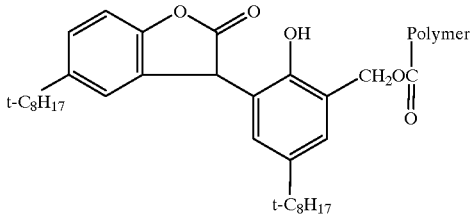

In one preferred embodiment, $R_2$ is the same as $R_3$, and n is the same as m.

$R_1$ preferably denotes hydrogen or acyl, and $R_2$ and $R_3$ preferably denote alkyl, wherein the sum of the C atoms in the alkyl radicals $R_2$ and $R_3$ is preferably $\geqq 8$. The preferred acyl radicals are radicals of aromatic and aliphatic carboxylic acids.

Examples of compounds of formula (I) and a method of producing them are disclosed in EP 871 066.

Compounds of formula (I) function as what are termed DOP scavengers (DOP=developer oxidation product).

However, a satisfactory level of colour reproduction is not attained by this measure in processing procedures in which the colour developer is at an elevated temperature and the developing time is short.

The object of the present invention was to provide a colour photographic material which is distinguished by good colour reproduction irrespective of the processing process.

This object is achieved by a material which contains a compound of formula (I) or formula (II) in a light-insensitive layer which is further from the support than is each of the light-sensitive layers.

(II)

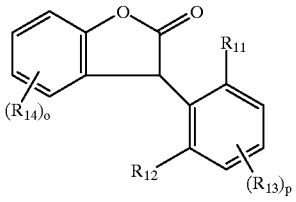

wherein $R_{11}$ and $R_{12}$ independently of each other denote alkyl, cycloalkyl, aryl, halogen, $SR_5$, $NR_6R_7$, nitro, cyano, $SO_2R_8$, $COOR_9$, $COR_{10}$ hetaryl oder hydrogen, $R_{13}$ and $R_{14}$ independently of each other denote $OR_{15}$ or $R_{11}$, $R_5$, $R_6$, $R_7$, $R_8$, $R_9$ and $R_{10}$ have the abovementioned meaning, $R_{15}$ denotes hydrogen alkyl or aryl, o denotes 0, 1 2, 3 or 4 and p denotes 0, 1, 2, or 3 and two together $R_{13}$ and $R_{14}$ together may denote the remaining members of a condensed carbocyclic or heterocyclic ring or the compound is linked via one of the radical $R_{13}$ and $R_{14}$ to a polymeric chain.

Examples of compounds of formula II, wherein $R_{11}$ and $R_{13}$ denote hydrogen atoms are:

| Nr. | $R_{14}$ | $R_{13}$ |
|---|---|---|
| II-1 | 2,4-dimethyl | H |
| II-2 | 2,4 di-tert.-butyl | H |
| II-3 | 4-t-octyl | 3,4-dimethyl |
| II-4 | 2,4-di-tert.-pentyl | 3,5-dimethyl-4-hydroxy |
| II-5 | 2-methyl-4-(2-ethylhexyloxy)-carbonamido | 4-methyl |
| II-6 | 2,4-dicyclopentyl | 3,5-dimethyl-4-acetoxy |
| II-7 | 2,4-di-tert.-butyl | 4-tert.-butyl |
| II-8 | 4-iso-dodecyl (mixture) | H |
| II-9 | 2-methyl-4-tert.-octyl | 4-methoxy |
| II-10 | 2,4-dimethyl | 3,4-di-isopropoxy |
| II-11 | 2,4-diisononyl | H |
| II-12 | 4-methyl | 3,5-di-tert.-butyl-4-hydroxy |
| II-13 | 2-tert.-butyl-4-methoxy | 3,4-dimethyl |
| II-14 | 3-$C_{15}H_{31}$ | 4-Hydroxy |
| II-15 | 4-methyl | 4-isotridecarboxy (mixture) |

The position of substituent $R_{14}$ is relative to the oxygen atom; the position of substituent $R_{13}$ is relative to the linkage of the phenyl ring.

Further examples are:

II-16

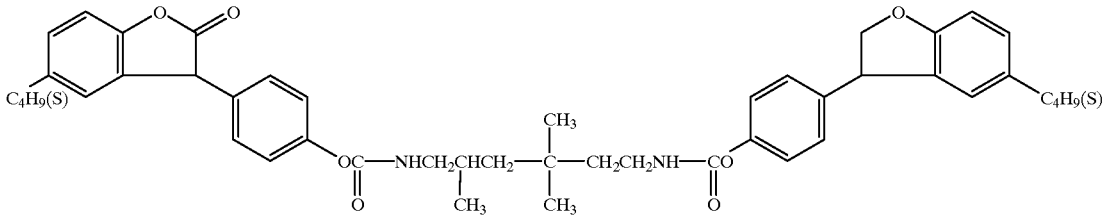

II-17

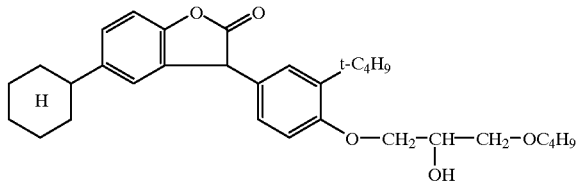

II-18

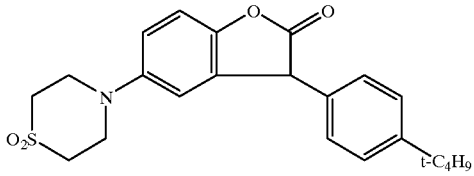

II-19

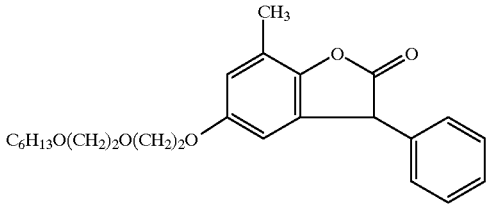

II-20

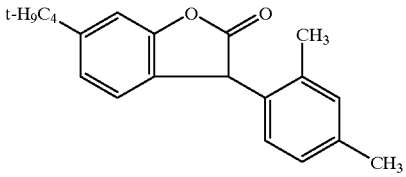

-continued

II-21

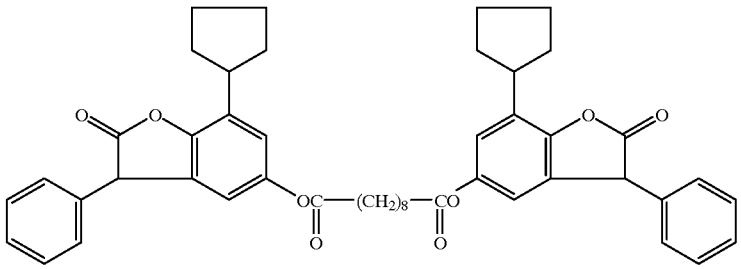

The present invention therefore relates to a colour photographic silver halide material which is developed as a negative, at least 90 mol % of the silver halides of which consist of AgCl, which contains at least one blue-sensitive silver halide emulsion layer containing at least one yellow coupler, at least one green-sensitive silver halide emulsion layer containing at least one magenta coupler, and at least one red-sensitive silver halide emulsion layer containing at least one cyan coupler, characterised in that a light-insensitive layer, which is further from the support than is each light-sensitive layer, contains a compound of formula (I) or formula (II).

The compounds of formula (I) or formula (II) are used in amount of 5 to 1000 mg/m$^2$ in particular, preferably 10 to 500 mg/m$^2$.

The compounds of formula (I) can also exist as a salt (phenolate); metal cations and ammonium ions are suitable as cations.

The compounds are preferably used as an emulsion. For this purpose, for example, 10 g of a compound of formula (I) or formula (II) and 8 g tricresyl phosphate can be dissolved at 40° C. in 6 g ethyl acetate and are emulsified, by means of a homogeniser at 200 bar and 40° C., in a gelatine phase comprising 8 g gelatine, 2 g of a commercially available emulsifier and 70 ml water: the ethyl acetate is subsequently distilled off.

The colour photographic material is preferably a copier material.

Photographic copier materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285.

Colour photographic copier materials usually comprise, in the following sequence on their support: a blue-sensitive, yellow-coupling silver halide emulsion layer, a green-sensitive, magenta coupling silver halide emulsion layer, and a red-sensitive, cyan-coupling silver halide emulsion layer: these layers can be interchanged with each other, for example by first depositing the green-sensitive layer on the support, then the red-sensitive layer and finally the blue-sensitive layer.

The essential constituents of the photographic emulsion layers are binders, silver halide grains and colour couplers.

Information on suitable binders is given in Research Disclosure 37254, Part 2 (1995), page 286.

Information on suitable silver halide emulsions, their production, ripening, stabilisation and spectral sensitisation, including suitable spectral sensitisers, is given in Research Disclosure 37254, Part 3 (1995), page 286, and in Research Disclosure 37038, Part XV (1995), page 89.

Precipitation can also be effected in the presence of sensitising dyes. Complexing agents and/or dyes can be rendered ineffective at any desired point in time, e.g. by altering the pH or by an oxidising treatment.

Information on colour couplers is to be found in Research Disclosure 37254, Part 4 (1995), page 288, and in Research Disclosure 37038, Part II (1995), page 80. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 mm diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, and in Research Disclosure 37038, Part III (1995), page 84.

The photographic material may additionally contain compounds which absorb UV light, brighteners, spacers, filter dyes, formalin scavengers, light stabilisers, anti-oxidants, $D_{Min}$ dyes, additives for improving the dye-, coupler- and white stability and to reduce colour fogging, plasticisers (latices), biocides and other substances.

Suitable compounds are given in Research Disclosure 37254, Part 8 (1995), page 292, and in Research Disclosure 37038, Parts IV, V, VI, VII, X, XI and XIII (1995), pages 84 et seq.

The layers of colour photographic materials are usually hardened, i.e. the binder used, preferably gelatine, is crosslinked by suitable chemical methods.

Instant or rapid hardeners are preferably used, wherein instant or rapid hardeners are understood to be compounds which crosslink gelatine so that immediately after casting, and a few days after casting at the latest, hardening has proceeded to such an extent that no further change in sensitometry or swelling of the layer composite occurs due to the crosslinking reaction. Swelling should be understood to mean the difference between the wet layer thickness and the dry layer thickness during the aqueous processing of the material.

Suitable instant and rapid hardener substances are described in Research Disclosure 37954, Part 9 (1995), page 294, and in Research Disclosure 37038, Part XII (1995), page 86.

After image-by-image exposure, colour photographic materials are processed by different methods corresponding to their character. Details on the procedures used and the chemicals required therefor are published in Research Disclosure 37254, Part 10 (1995), page 294, and in Research Disclosure 37038, Parts XVI to XXIII (1995), page 95, together with examples of materials. The colour photographic material according to the invention is particularly suitable for short-time processing with a development time of 10 to 30 seconds.

Halogen lamps or laser illumination sources are particularly suitable as light sources for exposure.

Suitable magenta couplers correspond to formulae III or IV (III)

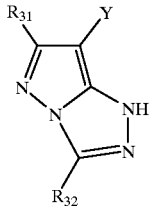

-continued (IV)

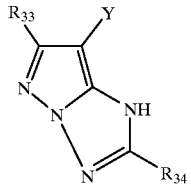

wherein $R_{31}$, $R_{32}$, $R_{33}$ and $R_{34}$, independently of each other, denote hydrogen, alkyl, aralkyl, aryl, aroxy, alkylthio, arylthio, amino, anilino, acylamino, cyano, alkoxycarbonyl, alkylcarbamoyl or alkylsulphamoyl, wherein these radicals can be further substituted and wherein at least one of these radicals contains a ballast group, and Y denotes a radical which is different from hydrogen and which can be split off during chromogenic coupling (a volatile group).

$R_{31}$ and $R_{33}$ are preferably tert.-butyl; Y is preferably chlorine.

These couplers are particularly advantageous on account of the colour brilliance of the magenta dyes produced with them.

The preferred couplers of formula III are those which correspond to the following formula:

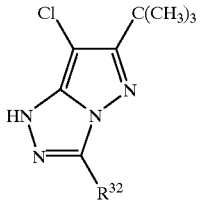

| Coupler | $R_{32}$ |
|---|---|
| III-1 | $—C_{13}H_{27}$ |
| III-2 | $—(CH_2)_3SO_2C_{12}H_{25}$ |
| III-3 | 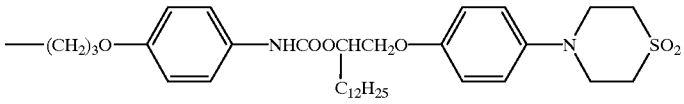 |
| III-4 | 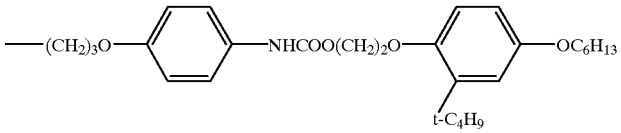 |
| III-5 | 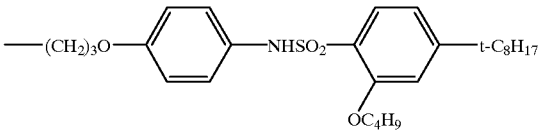 |

-continued
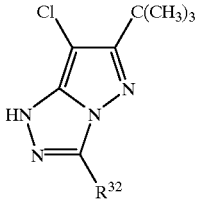
| Coupler | $R_{32}$ |
|---|---|
| III-6 | 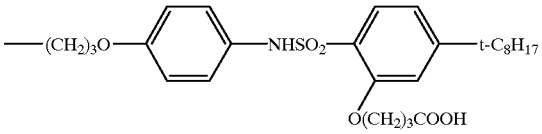 |
| III-7 | $—(CH_2)_2NHCOC_{13}H_{27}$ |
| III-8 | 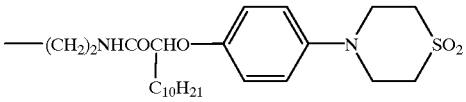 |
| III-9 | 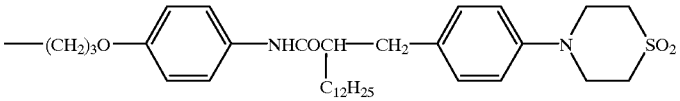 |
| III-10 | 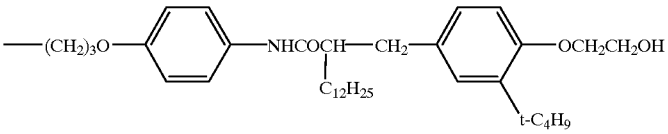 |
| III-11 | 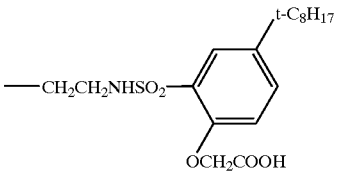 |
| III-12 | $—CH_2CH_2NHSO_2C_{16}H_{33}$ |
| III-13 | $—CH_2CH_2NHCONHC_{12}H_{25}$ |
| III-14 | $—(CH_2)_3NHSO_2C_{12}H_{25}$ |
| III-15 | 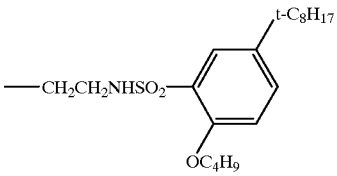 |
| III-16 | 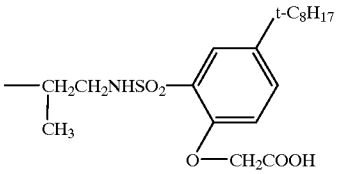 |

-continued
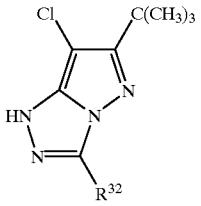
| Coupler | $R_{32}$ |
|---|---|
| III-17 | 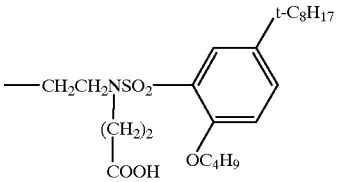 |
| III-18 | 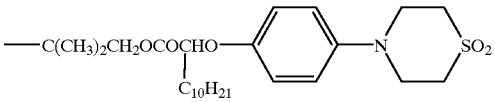 |
| III-19 | 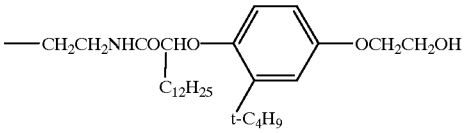 |
| III-20 | 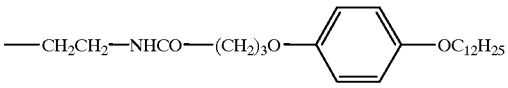 |
| III-21 | $—CH_2CH_2NHCOOC_{12}H_{25}$ |
as well as
III-22
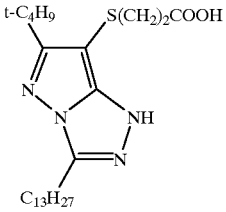
III-23
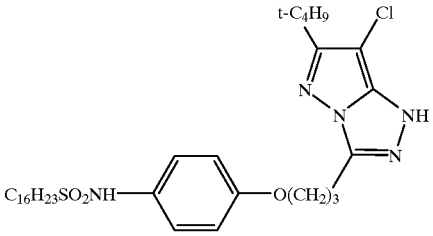
-continued
III-24
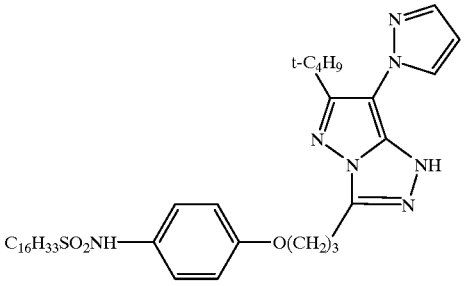
III-25
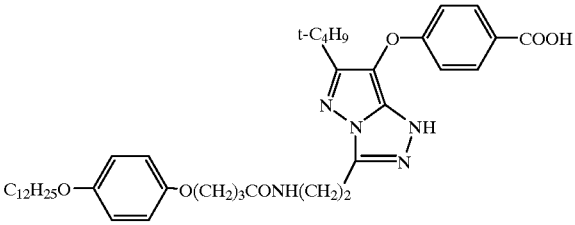
Suitable couplers of formula IV are couplers of the following formula:

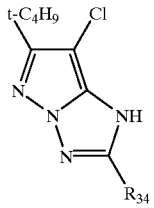
| Coupler | $R_{34}$ |
|---|---|
| IV-1 | 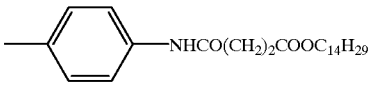 |
| IV-2 | 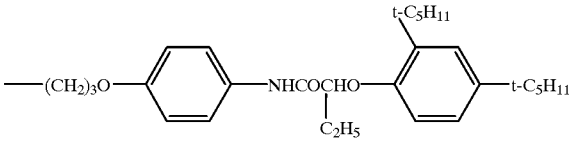 |
| IV-3 | 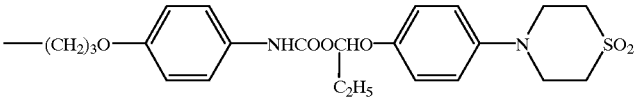 |
| IV-4 | 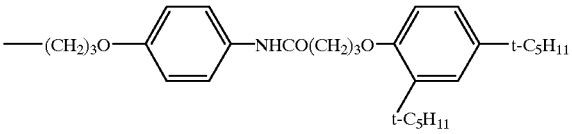 |
| IV-5 | 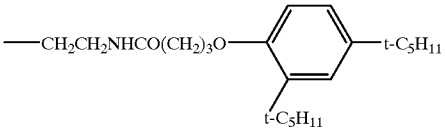 |
| IV-6 | 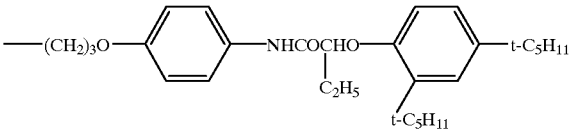 |
| IV-7 | 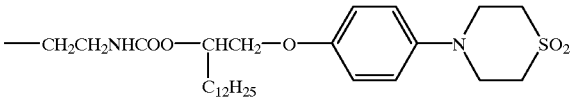 |
| IV-8 | 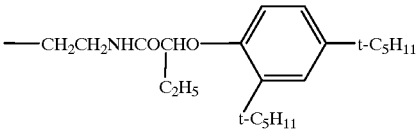 |
| IV-9 | $—CH_2CH_2NHCOC_{13}H_{27}$ |
| IV-10 | 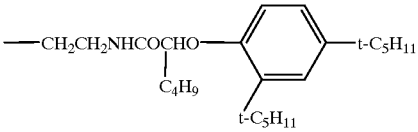 |

-continued
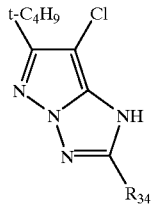
| Coupler | $R_{34}$ |
|---|---|
| IV-11 | $-(CH_2)_3SO_2C_{12}H_{25}$ |
| IV-12 | 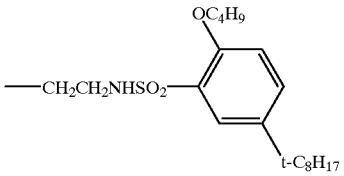 |
| IV-13 | 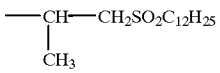 |
| IV-14 | 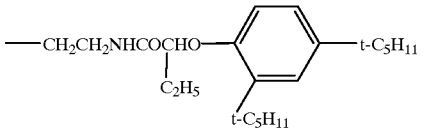 |
| IV-15 | 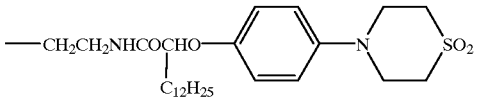 |
| IV-16 | 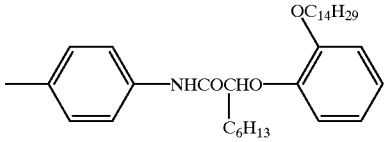 |
| IV-17 | 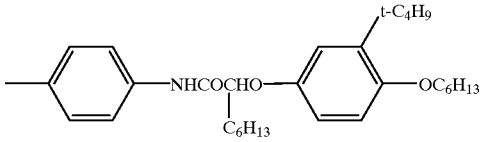 |
as well as
IV-18
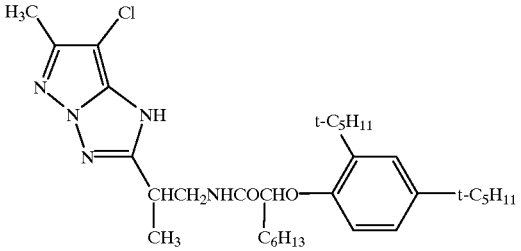
-continued
IV-19
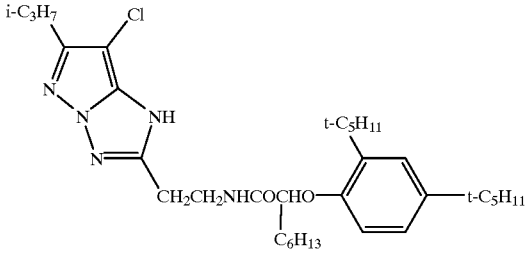

-continued

IV-20

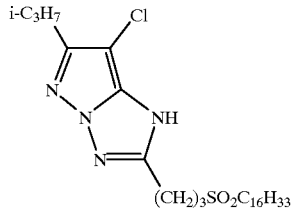

IV-21

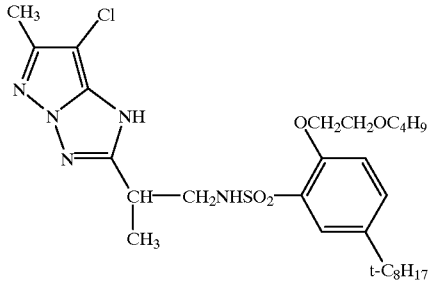

IV-22

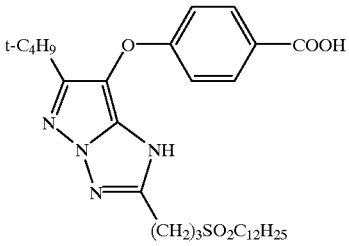

IV-23

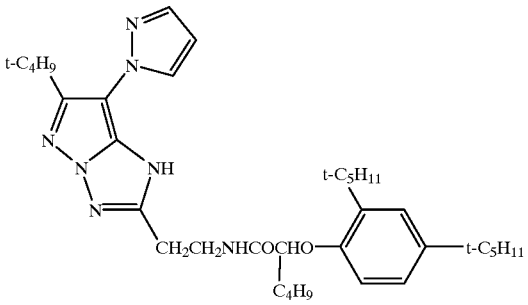

IV-24

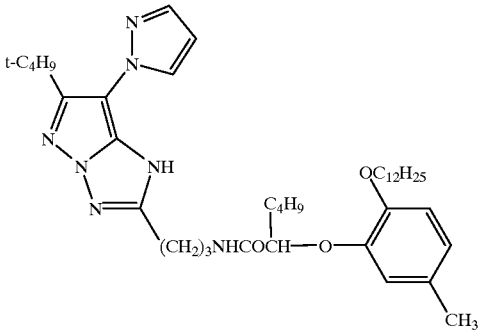

Suitable yellow couplers coitespond to formula V (V)

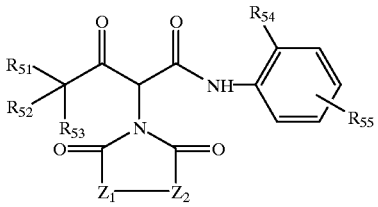

wherein $R_{51}$, $R_{52}$, $R_{53}$, independently of each other, denote alkyl, or $R_{52}$ and $R_{53}$ jointly form a three- to six-membered ring;

$R_{54}$ denotes alkyl, alkoxy or halogen, $R_{55}$ denotes halogen, alkyl, alkoxy, aryloxy, alkoxycarbonyl, alkylsulphonyl alkylcarbamoyl, arylcarbamoyl, alkylsulphamoyl or arylsulphamoyl;

$Z_1$, denotes —O— or —$NR_{56}$—;

$Z_2$ denotes —$NR_{57}$— or —$C(R_{58})R_{59}$—; and $R_{56}$, $R_{57}$, $R_{58}$ and $R_{59}$, independently of each other, denote hydrogen or alkyl.

$R_{51}$, $R_{52}$ and $R_{53}$ are preferably $CH_3$.

$R_{54}$ is preferably Cl or $OCH_3$.

$R_{55}$ is preferably —$COOR_{60}$, —$CONHR_{60}$ or —$SO_2NHCOR_{60}$, wherein $R_{60}$ is a $C_{10}$–$C_{18}$ alkyl.

Suitable cyan couplers correspond to formula VI (VI)

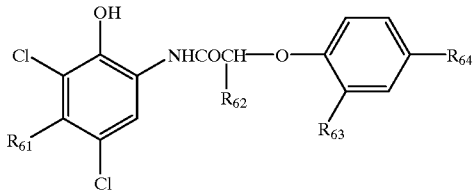

wherein $R_{61}$, $R_{62}$, $R_{63}$ and $R_{64}$, independently of each other, denote hydrogen or a $C_1$–$C_6$ alkyl.

$R_{61}$ is preferably $CH_3$ or $C_2H_5$.

$R_{62}$ is preferably $C_2$–$C_6$ alkyl.

$R_{63}$ and $R_{64}$ are preferably t-$C_4H_9$ or t-$C_5H_{11}$.

Examples of cyan couplers of formula VI include:

VI-1 wherein $R_{61}$=$C_2H_5$, $R_{62}$=n-$C_4H_9$, $R_{63}$=$R_{64}$=t-$C_4H_9$, VI-2 wherein $R_{61}$=$R_{62}$=$C_2H_5$, $R_{63}$=$R_{64}$=t-$C_5H_{11}$, VI-3 wherein $R_{61}$=$C_2H_5$, $R_{62}$=n-$C_3H_7$, $R_{63}$=$R_{64}$=t-$C_5H_{11}$, VI-4 wherein $R_{61}$=$CH_3$, $R_{62}$=$C_2H_5$, $R_{63}$=$R_{64}$=t-$C_3$—$H_{11}$.

The silver halide emulsions preferably contain not more than 8 mol % AgI; the balance is AgBr.

The silver halide emulsions preferably contain at least 95 mol % AgCl and are doped with at least one type of ions or of metal complexes of metals of Groups VIII and IIB or of Re, Au, Pb or Tl.

When doping is effected using more than one type of ions or metal complexes of metals of Groups VIII and IIB or of the metals Re, Au, Pb or Tl, these ions or metal complexes can be added to one zone or can be added separately to a plurality of zones.

The preferred ions or metal complexes are: $Ir^{3+}$, $Ir^{4+}$, $Rh^{3+}$ and $Hg^{2+}$.

Amount of $Ir^{3+}$, $Ir^{4+}$, $Rh^{3+}$: from 5 nmol/mol Ag to 50 μmol/mol Ag, preferably from 10 nmol/mol Ag to 500 μmol/mol Ag.

amount of $Hg^{2+}$: from 0.5 μmol/mol Ag to 100 μmol/mol Ag, preferably from 1 μmol/mol Ag to 30 μmol/mol Ag.

Method of addition of $Ir^{3+}$, $Ir^{4+}$, $Rh^{3+}$ and $Hg^{2+}$: in an NaCl solution which is run in.

An inner zone, preferably the core, is preferably doped with $Hg^{2+}$, and an outer zone, particularly the outermost zone, is preferably doped with $Ir^{3+}$, $Ir^{4+}$ and/or $Rh^{3+}$.

Production of Silver Halide Emulsions

0. Micrate Emulsion (EmM1) (dopant-free micrate)

The following solutions were made up with demineralised water:

| | | |
|---|---|---|
| Solution 01 | 5500 g | water |
| | 700 g | gelatine |
| | 5 g | n-decanol |
| | 20 g | NaCl |
| Solution 02 | 9300 g | water |
| | 1800 g | NaCl |
| Solution 03 | 9000 g | water |
| | 5000 g | $AgNO_3$ |

Solutions 02 and 03 were added, simultaneously and with intensive stirring, to solution 01 over 30 minutes at a constant rate of addition at pAg 7.7 and pH 5.0. During the precipitation, the pAg was held constant by adding an NaCl solution to the precipitation vessel and the pH was held constant by adding $H_2SO_4$. An AgCl emulsion with an average particle diameter of 0.09 μm was obtained. The gelatine/$AgNO_3$ ratio by weight was 0.14. The emulsion was subjected to ultra-filtration at 40° C., washed, and re-dispersed with an amount of gelatine and water such that the gelatine/$AgNO_3$ ratio by weight was 0.3 and the emulsion contained 200 g AgCl per kg. After re-dispersion, the grain size was 0.12 μm.

1. Blue-sensitive Emulsion EmB

The following solutions were made up with demineralised water:

| | | |
|---|---|---|
| Solution 11 | 1100 g | water |
| | 136 g | gelatine |
| | 1 g | n-decanol |
| | 4 g | NaCl |
| | 65 g | EmM1 |
| Solution 12 | 1860 g | water |
| | 360 g | NaCl |
| | 57 μg | $K_2IrCl_6$ |
| Solution 13 | 1800 g | water |
| | 1000 g | $AgNO_3$ |

Solutions 12 and 13 were added, simultaneously and with intensive stirring, to solution 11 which had been placed in the precipitation vessel, over 150 minutes and at a pAg of 7.7. The pAg and pH values were controlled as in the precipitation of emulsion (EmMI). The addition was regulated so that over the first 100 minutes the rate of addition of the solution 13 was increased linearly from 2 ml/min to 18 ml/min and in the remaining 50 minutes a constant rate of addition of 20 ml/min was employed. An AgCl emulsion with an average particle diameter of 0.71 μm was obtained. The emulsion contained 10 nmol $Ir^{4+}$ per mol AgCl. The gelatine/$AgNO_3$ ratio by weight (the amount of AgCl in the emulsion is hereinafter converted to $AgNO_3$) was 0.14. The emulsion was subjected to ultrafiltration, washed, and re-dispersed with an amount of gelatine and water such that the gelatine/$AgNO_3$ ratio by weight was 0.56 and the emulsion contained 200 g $AgNO_3$ per kg.

The emulsion was ripened for 2 hours, at a pH of 0.53 and at a temperature of 40° C., with the optimum amount of gold(III) chloride and $Na_2S_2O_3$. After chemical ripening, the emulsion was spectrally sensitised at 40° C. with 30 mmol of compound (Sens B) per mol AgCl, was stabilised with 0.4 mmol of compound (Stab 1) and was subsequently treated with 0.006 mol KBr.

SensB:

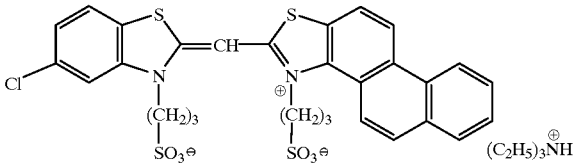

Stab-1:

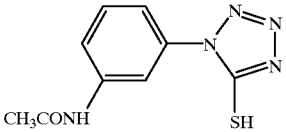

2. Green-sensitive Emulsions EmG;

The following solutions were made up with demineralised water:

| | | |
|---|---|---|
| Solution 21 | 1100 g | water |
| | 136 g | gelatine |
| | 1 g | n-decanol |
| | 4 g | NaCl |
| | 186 g | EmM1 |
| Solution 22 | 1860 g | water |
| | 3600 g | NaCl |
| | 57 μg | $K_2IrCl_6$ |
| Solution 23 | 1800 g | water |
| | 1000 g | $AgNO_3$ |
| | 4.8 mg | $HgCl_2$ |

Solutions 22 and 23 were added at 40° C., simultaneously and with intensive stirring, to solution 21 which had been placed in the precipitation vessel, over 75 minutes and at a pAg of 7.7. The pAg and pH values were controlled as in the precipitation of emulsion (EmMI). The addition was regulated so that over the first 50 minutes the rate of addition of solution 23 was increased linearly from 4 ml/min to 36 ml/min and in the remaining 25 minutes a constant rate of addition of 40 ml/min was employed. An AgCl emulsion with an average particle diameter of 0.50 μm was obtained. The emulsion contained 10 nmol $Ir^{4+}$ and 3 μmol $HgCl_2$ per mol AgCl. The gelatine/$AgNO_3$ ratio by weight was 0.14. The emulsion was subjected to ultrafiltration, washed, and re-dispersed with an amount of gelatine and water such that the gelatine/$AgNO_3$ ratio by weight was 0.56 and the emulsion contained 200 g $AgNO_3$ per kg.

2.5 kg of the emulsion (corresponding to 500 g $AgNO_3$) was ripened for 2 hours, at a pH of 0.53 and at a temperature of 60° C., with the optimum amount of gold(III) chloride and $Na_2S_2O_3$. After chemical ripening, the emulsion was spectrally sensitised at 50° C. with 40 mmol of compound (Sens G) per mol AgCl, was stabilised with 0.4 mmol of compound (Stab 1), with 0.4 mmol of compound (Stab 2) and with 0.4 mmol of compound (Stab 3), and was subsequently treated with 0.01 mol KBr.

SensG:

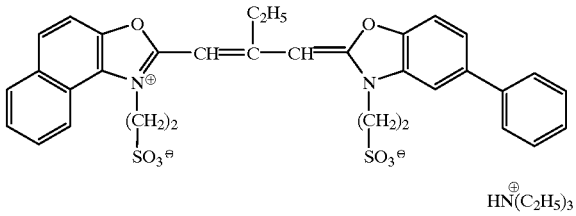

Stab-2:

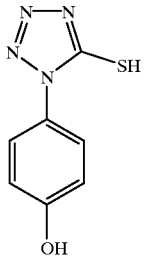

Stab-3:

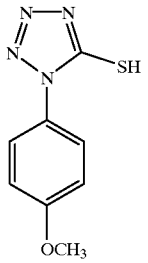

Red-sensitive Emulsion EmR

Precipitation, salt removal and re-dispersion were effected as for the green-sensitive emulsion EmG 1. After chemical ripening with the optimum amount of gold(III) chloride and $Na_2S_2O_3$ ata temperature of 60° C., the emulsion was spectrally sensitised at 40° C. with 40 μmol of compound (Sens R1) and with 10 μmol of compound (Sens R2), and was stabilised with 954 μmol (Stab 1) and 2.24 mmol (Stab 4) per mol AgNO3; 0.003 mol KBr were subsequently added.

SensR1

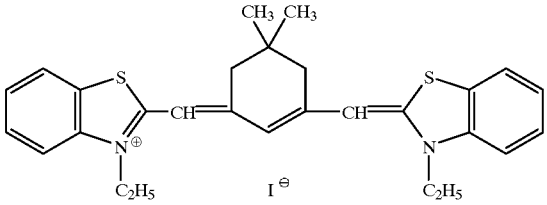

-continued

Sens R2

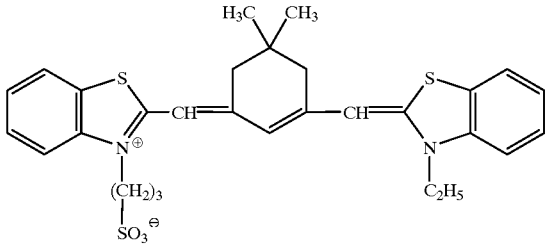

Stab-4

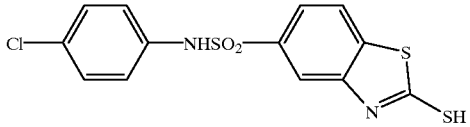

Layer Structures

A colour photographic recording material was produced by depositing the following layers in the given sequence on a film base comprising paper coated on both sides with polyethylene. The quantitative data are given with respect to 1 $m^2$ in each case. The corresponding amounts of $AgNO_3$ are quoted for silver halide deposition.

Layer Structure 1

1st Layer (substrate layer):

0.3 g gelatine

2nd Layer (blue-sensitive layer):

EmB comprising 0.4 g $AgNO_3$ 0.635 g gelatine 0.35 g yellow coupler GB-1

0.15 g yellow coupler GB-2

0.38 g tricresyl phosphate (TCP)

3rd Layer (intermediate layer):

1.1 g gelatine 0.08 g scavenger SC 0.02 g white coupler WK 0.1 g TCP

4th Layer (green-sensitive layer):

EmG comprising 0.23 g AgNO3

1.2 g gelatine 0.23 g magenta coupler III-2

0.23 g colour stabiliser ST-1

0.17 g colour stabiliser ST-2

0.23 g TCP

5th Layer (UV protection layer):

1.1 g gelatine 0.08 g SC 0.02 g WK 0.6 g UV absorber UV 0.1 g TCP

6th Layer (red-sensitive layer):

EmR comprising 0.26 g $AgNO_3$, with 0.75 g gelatine 0.40 g cyan coupler VI-2

0.36 g TCP

7th Layer (UV protection layer):

0.35 g gelatine 0.15 g UV 0.075 g TCP

8th Layer (protective layer):

0.90 g gelatine 0.3 g hardener HM

Layer structure 2:

as layer structure 1, except that the 7$^{th}$ layer additionally contained 0.05 g of compound SC.

Layer Structure 3:

as layer structure 1, except that in the 3rd layer the same amount of magenta coupler III-1 was used instead of magenta coupler III-2.

Layer Structure 4:

as layer structure 3, except that the 7$^{th}$ layer additionally contained 0.2 g of compound SC.

Layer Structure 5:

as layer structure 3, except that the 7$^{th}$ layer additionally contained 0.2 g of compound (II-2).

Layer Structure 6:

as layer structure 3, except that the 7$^{th}$ layer additionally contained 0.2 g of compound (II-20).

Compounds used for the first time in layer structures 1 to 6:

GB-1

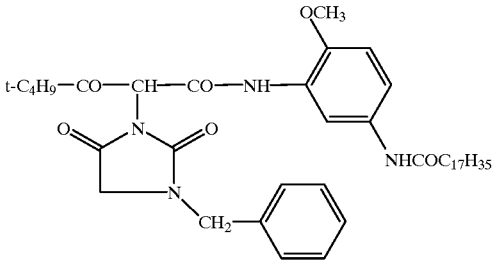

GB-2

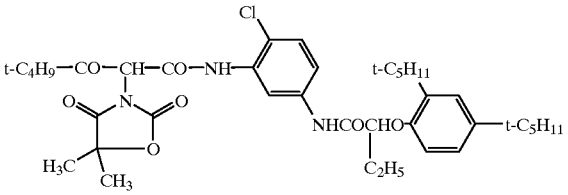

SC

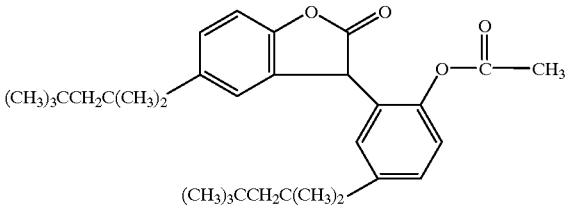

WK

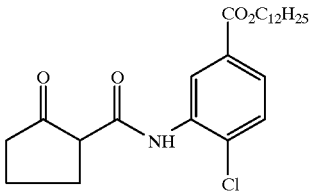

ST-1

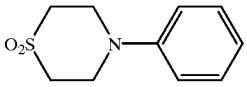

-continued

ST-2

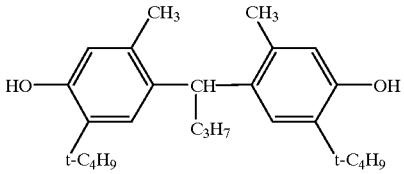

UV

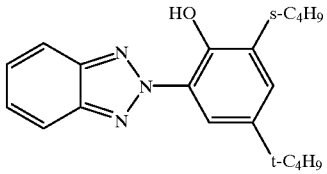

HM

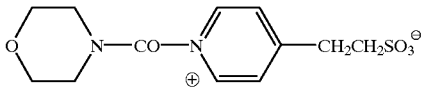

Processing:

Selective Integral Exposure:

The samples were exposed behind a graduated 30-step model neutral wedge filter which had a density gradation of 0.1/step, for a time of exposure of 40 ms and using a constant amount of light. To effect selective blue, green or red exposure of the samples, corresponding sets of blue filters (U438+U449 X with maximum transparency at 445 mm), green filters (U531 with maximum transparency at 531 nm) or red filters (L622) were inserted between the light source and the model neutral wedge filter. After exposure, the samples were processed as follows, using the following processes:

| Process AP 94 (standard process) | | |
|---|---|---|
| a) | Colour developer - 45 seconds −35° C. | |
| | triethanolamine | 9.0 g |
| | N,N-diethylhydroxylamine | 4.0 g |
| | diethylene glycol | 0.05 g |
| | 3-methyl-4-amino-N-ethyl-N-methane-sulphonamidoethyl-aniline sulphate | 5.0 g |
| | potassium sulphite | 0.2 g |
| | triethylene glycol | 0.05 g |
| | potassium carbonate | 22 g |
| | potassium hydroxide | 0.4 g |
| | ethylenediaminetetraacetic acid, di-Na salt | 2.2 g |
| | potassium chloride | 2.5 g |
| | 1,2-dihydroxybenzene-3,4,6-trisulphonic acid, trisodium salt | 0.3 g |
| | made up with water to 1000 ml; pH 10.0 | |
| b) | Bleach fixing bath - 45 seconds −35° C. | |
| | ammonium thiosulphate | 75 g |
| | sodium hydrogen sulphite | 13.5 g |
| | ammonium acetate | 2.0 g |
| | ethylenediaminetetraacetic acid (iron ammonium salt) | 57 g |
| | 25% ammonia | 9.5 g |
| | made up with vinegar to 1000 ml; pH 5.5 | |
| c) | Washing - 2 minutes −33° C. | |
| d) | Drying | |

| Short-time process | |
|---|---|
| Colour developer 33 seconds −38° C. | |
| tetraethylene glycol | 20.0 g |
| N,N-diethylhydroxylamine | 4.0 g |
| (N-ethyl-N-(2-methanesulphonamido)ethyl))-4-amino-3-methylbenzene sulphate | 5.0 g |
| potassium sulphite | 0.2 g |
| potassium carbonate | 30.0 g |
| polymaleic anhydride | 2.5 g |
| hydroxyethanediphosphonic acid | 0.2 g |
| optical brightener (4,4'-diaminostilbene type) | 2.0 g |
| potassium bromide | 0.02 g |
| made up with water to 1000 ml; pH adjusted to 10.2 with KOH or $H_2SO_4$. | |
| Bleach fixing bath - 33 seconds −36° C. | |
| ammonium thiosulphate solution, 58% by weight | 110 ml |
| ammonia, 25% by weight | 2.7 ml |
| sodium disulphite 16.2 g | |
| ammonium iron EDTA, 48% by weight | 101 ml |
| acetic acid, 85% by weight | 7.7 ml |
| made up with water to 1000 ml; pH adjusted to 5.85 with ammonia or phosphoric acid. | |

| Stabilising bath - 90 seconds −36° C. | |
|---|---|
| water | 900 ml |
| sodium disulphite | 2 g |
| hydroxyethanediphosphonic acid; disodium salt | 4 g |
| sodium benzoate | 0.5 g |
| made up with water to 1000 ml. | |

Drying

Sensitometric results corresponding to the graduated yellow, magenta and cyan colour density curves which were obtained by selective exposure were measured by means of an X-Rite 414 Status A and were represented in the form of the following parameters:

$D_{min\ yell}$: yellow density in the region of the yellow colour density curve in the unexposed region $PD_{yell}$ (1.5): yellow density=1.5 on the yellow colour density curve $SD_{mag\ in\ yell\ (1.5)}$: magenta density (measured behind a green filter) at a yellow density (measured behind a blue filter)=1.5 on the yellow colour density curve $SD_{cyan\ in\ yell\ (1.5)}$: cyan density (measured behind a red filter) at a yellow density (measured behind a blue filter)=1.5 on the yellow colour density curve.

The parameters for magenta and cyan were defined as for yellow.

The yellow colour reproduction at a yellow density of 1.5 is defined as follows:

magenta density (mag secondary colour density; in %) in yellow during selective exposure to blue:

$$MSD_{mag\ in\ yell}\ (1.5)=100\%\times(SD_{mag\ in\ yell}\ (1.5)-D_{min\ mag})/(PD_{yell}\ (1.5)-Dmin_{yell})$$

cyan density (cyan secondary colour density; in %) in yellow during selective exposure to blue:

$$MSD_{cyan\ in\ yell}\ (1.5)=100\%\times(SD_{cyan\ in\ yell}\ (1.5)-D_{min\ cyan})/(PD_{yell}\ (1.5)-Dmin_{yell})$$

The parameters for magenta and cyan were defined as for yellow.

APPENDIX 2

Results:
Table of secondary color density at a primary density of 1.5

| Layer structure | Process | $MSD_{mag\ in\ yell}$ | $MSD_{cyan\ in\ yell}$ | $MSD_{yell\ in\ mag}$ | $MSD_{cyan\ in\ mag}$ | $MSD_{yell\ in\ cyan}$ | $MSD_{mag\ in\ cyan}$ | Remarks |
|---|---|---|---|---|---|---|---|---|
| 1 | AP 94 | 11.0 | 2.4 | 24.3 | 7.1 | 11.0 | 25.1 | C |
| | KP | 11.6 | 2.4 | 24.9 | 9.3 | 11.2 | 25.3 | |
| 2 | AP 94 | 11.0 | 2.3 | 24.2 | 6.9 | 11.0 | 25.1 | I |
| | KP | 11.4 | 2.2 | 24.7 | 8.0 | 11.0 | 25.2 | |
| 3 | AP 94 | 12.1 | 2.1 | 25.9 | 7.7 | 12.0 | 25.2 | C |
| | KP | 12.3 | 2.1 | 27.1 | 10.5 | 11.9 | 25.3 | |
| 4 | AP 94 | 12.1 | 2.0 | 25.6 | 7.4 | 12.0 | 25.2 | I |
| | KP | 12.0 | 1.8 | 26.9 | 9.1 | 11.9 | 25.1 | |
| 5 | AP 94 | 12.0 | 2.1 | 25.7 | 7.6 | 11.9 | 25.2 | I |
| | KP | 11.9 | 1.8 | 27.2 | 9.0 | 12.0 | 25.2 | |
| 6 | AP 94 | 11.8 | 2.0 | 25.5 | 7.3 | 11.8 | 25.1 | I |
| | KP | 12.1 | 1.9 | 27.0 | 9.2 | 12.0 | 25.0 | |

C = comparison; I = invention

It can be seen from the Table that the secondary colour densities can be reduced by the addition of the compound of formula (I) or formula (II) (Sc) to the 7th layer. In particular, the cyan secondary colour density in magenta is reduced after the short-time processing procedure.

What is claimed is:

1. A color photographic silver halide material which is developed as a negative, which comprises at least 90 mol % of the silver halides of which consists of AgCl, which contains at least one blue-sensitive silver halide emulsion layer containing at least one yellow coupler, at least one green-sensitive silver halide emulsion layer containing at least one magenta coupler, and at least one red-sensitive silver halide emulsion layer containing at least one cyan coupler, a light-insensitive layer, which is further from the support than each of the light-sensitive layers, contains a compound of formula (II)

(II)

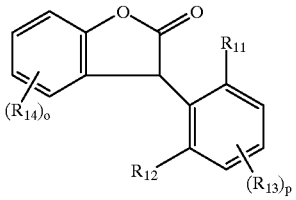

wherein $R_{11}$ and $R_{12}$ independently of each other alkyl, cycloalkyl, aryl, halogen, $SR_5$, $NR_6R_7$, nitro, cyano $SO_2R_8$, $COOR_9$, $COR_{10}$ heteroaryl or hydrogen, $R_{13}$ and $R_{14}$ independently of each other denote $OR_{15}$ or $R_{11}$, $R_4$, $R_5$, and $R_9$, independently of each other, denote alkyl, cycloalkyl, alkenyl, aryl or heteroaryl, $R_6$ and $R_7$, independently of each other, denote H, $R_4$, $COR_{10}$, $COOR_9$ or $SO_2R_8$, $R_8$ and $R_{10}$, independently of each other, denote alkyl, cycloalkyl, alkenyl, aryl, heteroaryl or $NR_6R_7$, $R_{15}$ denotes hydrogen alkyl or aryl, o denotes 0, 1, 2, 3 or 4 and p denotes 0, 1, or 3 and two radicals $R_{13}$ and $R_{14}$ together may denote the remaining members of a condensed carbocyclic or heterocyclic ring or the compound is linked via one of the radical $R_{13}$ and $R_{14}$ to a polymeric chain.

2. The color photographic material according to claim 1, wherein light-insensitive layer which is further from the support than each light-sensitive layer contains the compound of formula (II) in an amount of 5 to 1000 mg/m$^2$.

3. The color photographic material according to claim 1, wherein light-insensitive layer which is further from the support than each light-sensitive layer contains the compound of fomula (II) in an amount of 10 to 500 mg/m$^2$.

4. The color photographic material according to claim 1, wherein the color photographic material is a copier material.

5. The color photographic material according to claim 1, wherein the material has at least seven layers and the compound of formula (II) is used in at least the seventh layer.

6. The color photographic halide material according to claim 1, wherein between said at least one blue sensitive layer and said at least one green sensitive layer is an intermediate layer and between said green sensitive layer and said red sensitive layer is a non-color sensitive layer.

7. The color photographic silver halide material according to claim 1, wherein the light insensitive layer contains a compound of the formula (II) and the light insensitive layer is a protective layer.

* * * * *

UNITED STATES PATENT AND TRADEMARK OFFICE

CERTIFICATE OF CORRECTION

PATENT NO. : 6,284,447 B1
DATED : September 4, 2001
INVENTOR(S) : Ly et al.

It is certified that error appears in the above-identified patent and that said Letters Patent is hereby corrected as shown below:

Title page,
Inventors, Cuong Ly's residence has been listed as "Cologne". The correct residence of Cuong Ly is -- Koln --.

Signed and Sealed this

Twelfth Day of March, 2002

*Attest:*

*Attesting Officer*

JAMES E. ROGAN
*Director of the United States Patent and Trademark Office*